US007434707B2

(12) United States Patent
Meshberg

(10) Patent No.: US 7,434,707 B2
(45) Date of Patent: Oct. 14, 2008

(54) CHILDPROOF ATTACHMENT FOR A DISPENSER

(75) Inventor: Philip Meshberg, Palm Beach, FL (US)

(73) Assignee: Dispensing Patents International, LLC, Boynton Beach, FL (US)

( * ) Notice: Subject to any disclaimer, the term of this patent is extended or adjusted under 35 U.S.C. 154(b) by 641 days.

(21) Appl. No.: 10/912,173

(22) Filed: Aug. 6, 2004

(65) Prior Publication Data

US 2005/0035154 A1 Feb. 17, 2005

Related U.S. Application Data

(63) Continuation-in-part of application No. 10/754,615, filed on Jan. 12, 2004, now Pat. No. 6,971,552, which is a continuation-in-part of application No. 09/933,011, filed on Aug. 21, 2001, now Pat. No. 6,691,896.

(51) Int. Cl.
*B67B 5/00* (2006.01)
*B65D 55/02* (2006.01)
*B65D 53/00* (2006.01)

(52) U.S. Cl. ..... 222/153.14; 215/216; 220/214

(58) Field of Classification Search ..... 222/212, 222/213, 464.1, 153.13, 153.14; 215/216; 220/214

See application file for complete search history.

(56) References Cited

U.S. PATENT DOCUMENTS 2,717,727 A * 9/1955 Robb ..... 222/512
4,432,496 A * 2/1984 Ito ..... 239/327
4,773,567 A * 9/1988 Stoody ..... 222/153.11
5,328,058 A * 7/1994 Leoncavallo et al. ... 222/153.14
5,711,488 A * 1/1998 Lund ..... 239/333
5,979,681 A * 11/1999 Varlet et al. ..... 215/216
6,478,193 B1 * 11/2002 Good et al. ..... 222/153.14
6,766,922 B2 * 7/2004 da Silva ..... 222/211

* cited by examiner

*Primary Examiner*—Kevin P. Shaver
*Assistant Examiner*—Melvin A Cartagena
(74) *Attorney, Agent, or Firm*—Kenyon & Kenyon LLP

(57) ABSTRACT

In one embodiment, an arrangement for assembly to a squeeze bottle having a threaded neck with an opening at its outer end upon filling of the bottle is provided. The squeeze bottle has a dispensing nozzle unit adapted to be fixedly inserted into the opening and the nozzle unit includes a lower cylindrical part terminating in a flange at its outer end. A washer, through which the cylindrical part is adapted to extend, is interposed between the flange and the outer end of said neck with a hinged tab formed as part of and extending from the washer. Also included is a cover for the nozzle having internal threads to screw onto the neck. The cover has a recess formed therein, the recess having a vertical wall, such that, when said cover is screwed on the neck, the hinged tab will have a portion abutting the wall and preventing movement, unless the tab is pushed in so that the portion clears the wall.

14 Claims, 9 Drawing Sheets

CHILDPROOF ATTACHMENT FOR A DISPENSER

This non-provisional application is a continuation-in-part of U.S. patent application Ser. No. 10/754,615, filed on Jan. 12, 2004, now U.S. Pat. No. 6,971,552, which is a continuation-in-part of U.S. patent application Ser. No. 09/933,011, filed on Aug. 21, 2001, now U.S. Pat. No. 6,691,896, the disclosure of both of which is incorporated herein by reference in their entirety. This non-provisional application is also related to U.S. patent application Ser. No. 10/635,527, filed on Aug. 7, 2003, now U.S. Pat. No. 6,932,244.

TECHNICAL FIELD

The present invention relates to containers, generally, and, more particularly, to a childproof attachment for a dispenser such as a squeeze bottle and to a dispenser having such an attachment.

BACKGROUND OF THE INVENTION

Squeeze bottle dispensers, for example, for nasal applications, are known. These typically include a bottle with a threaded neck with an outlet opening at the end of the neck. A nozzle, having a dip tube extending from the nozzle, is press fit into the opening in the neck. A cap or cover covers the nozzle and is screwed onto the threads of the neck. Similar packages can be used for dispensing, for example, eye drops. Other bottles are adapted to pour a medicine or household product and do not include a nozzle, but can include another type of insert. In place of a cover, these dispensers or containers have a screw-on cap.

Although the squeeze bottle dispenser has a cover protecting the nozzle from contamination, the cover can easily be removed. In other words, it is not childproof. That is, it is relatively easy, by rotation, to remover the cover and dispense material. Most of the materials or medicines that are dispensed are toxic if ingested. Thus, a young child could pick up a dispenser containing a toxic material and ingest it. The danger in other types of containers such as medicine bottles and containers for household chemicals, that a child might open and ingest a harmful substance is also well known and various childproof mechanisms have been proposed for these containers.

Another type of dispenser is the spray dispenser shown in U.S. Pat. No. 5,593,064, the disclosure of which is hereby incorporated by reference in its entirety. This is a promotional dispensing package which is easily shipped, filled and assembled. The package includes a retaining opening into which a modular pump is snap-fit by inserting the modular pump through an open end of the package. The package also includes an upstanding wall, which provides a dispensing actuator locking and sealing mechanism, as well as a tamper-evident tab. The package and pump are assembled at a production site, and are thereafter shipped to a filling site with a bottom. The package is filled through the open bottom end, and then the bottom is sealingly affixed to the package. Accordingly, the device can be filled and finally assembled with a minimal number of steps, and is therefore particularly suited for quick-turnaround marketing. Although the package includes a dispensing actuator locking and sealing mechanism, as well as a tamper-evident tab, it is not childproof. That is, it is relatively easy, by rotation, to unlock the actuator and dispense material. In some cases the package might be used, for example, for a breath freshener and spraying in the mouth is expected. However, the package might also contain insect repellant, sun tan lotion, or another product which is toxic if ingested. Particularly in view of these multiple uses, a young child could pick up a dispenser containing a toxic material and ingest it.

SUMMARY OF THE INVENTION

In accordance with embodiments of the present invention, an attachment for a dispensing package, or container has a first part which is fixed and a second part which is movable from a position where dispensing is prevented to a position where dispensing is possible. A recess, e.g., an opening is formed in one of the first and second parts and has a wall. A hinged tab is formed on the other of the first and second parts and has a portion abutting the wall and preventing movement of the second part unless the tab is pushed in so that the portion abutting the wall clears the wall, while at the same time moving the first part to the position where dispensing is possible.

DETAILED DESCRIPTION

Figure 1:
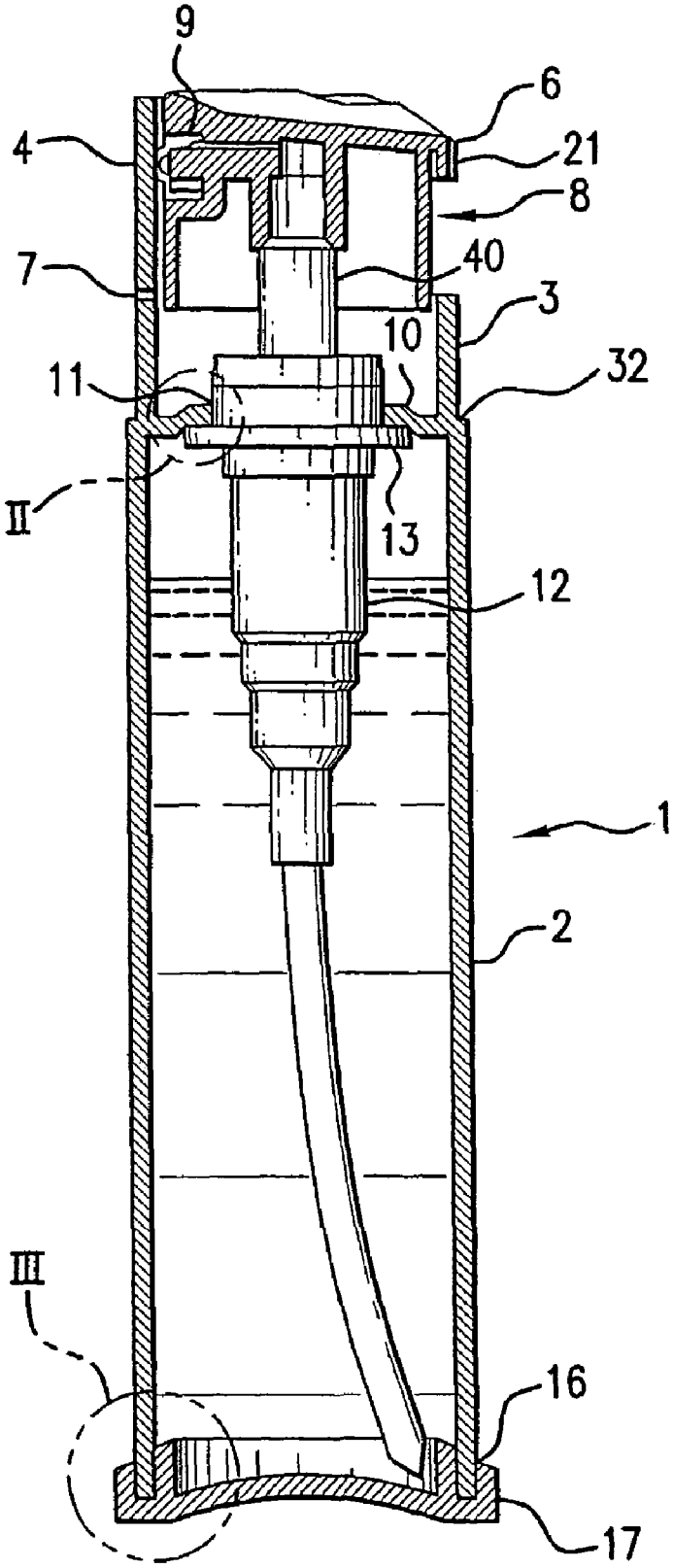
FIG. 1 is a cross-sectional view of a pump dispenser with which the present invention may be used.

An embodiment of a dispenser with which the present invention may be used is shown in cross-sectional view, in a sealed condition, in FIG. 1. The dispenser includes a package 1 which includes a container 2 and an upstanding wall 3 forming a sleeve. Upstanding wall 3 includes a tamper evident tab 4, connected to the upstanding wall 3 by a snap-away or tear-away joint 7. Joint 7 is originally molded to integrally connect tab 4 to upstanding wall 3, but is designed to be of sufficient thinness so that an end user can ultimately break the joint 7 so that the tab 4 can be removed from sleeve 3 to uncover nozzle 9 on actuator 6 when it is desired to first use the dispenser 1. Upstanding wall 3 can include an opening 8 intended to facilitate movement of an actuator nozzle 9 within the upstanding wall 3. Although shown as being vertically oriented in FIGS. 1, tab 4 could also be oriented in a horizontal direction, with the joint 7 being disposed vertically at one end of the tab 4.

Container 2 and upstanding wall 3 are separated by a retaining wall 10 which includes a retaining opening 11 used to secure a pump 12 in the package 1. Pump 12 can be of any conventional design. Pump 12 includes a retention flange 13 for limiting the amount of inward movement of the pump 12 into the container 1 and for providing a surface for an energy director (not shown) to adhere during a process of sonic or ultrasonic welding. Alternatively, pump could include a retention groove which retains the pump 12 in the package 1 via a snap-fit engagement with retaining wall 10. Pump 12 is inserted into retaining opening 11 through the lower end 16 of container 2 or from the upper end including the upstanding wall 3, which is initially open. Pump 12 has a projecting stem 40 on the end of which actuator 6 is mounted.

Figure 2:
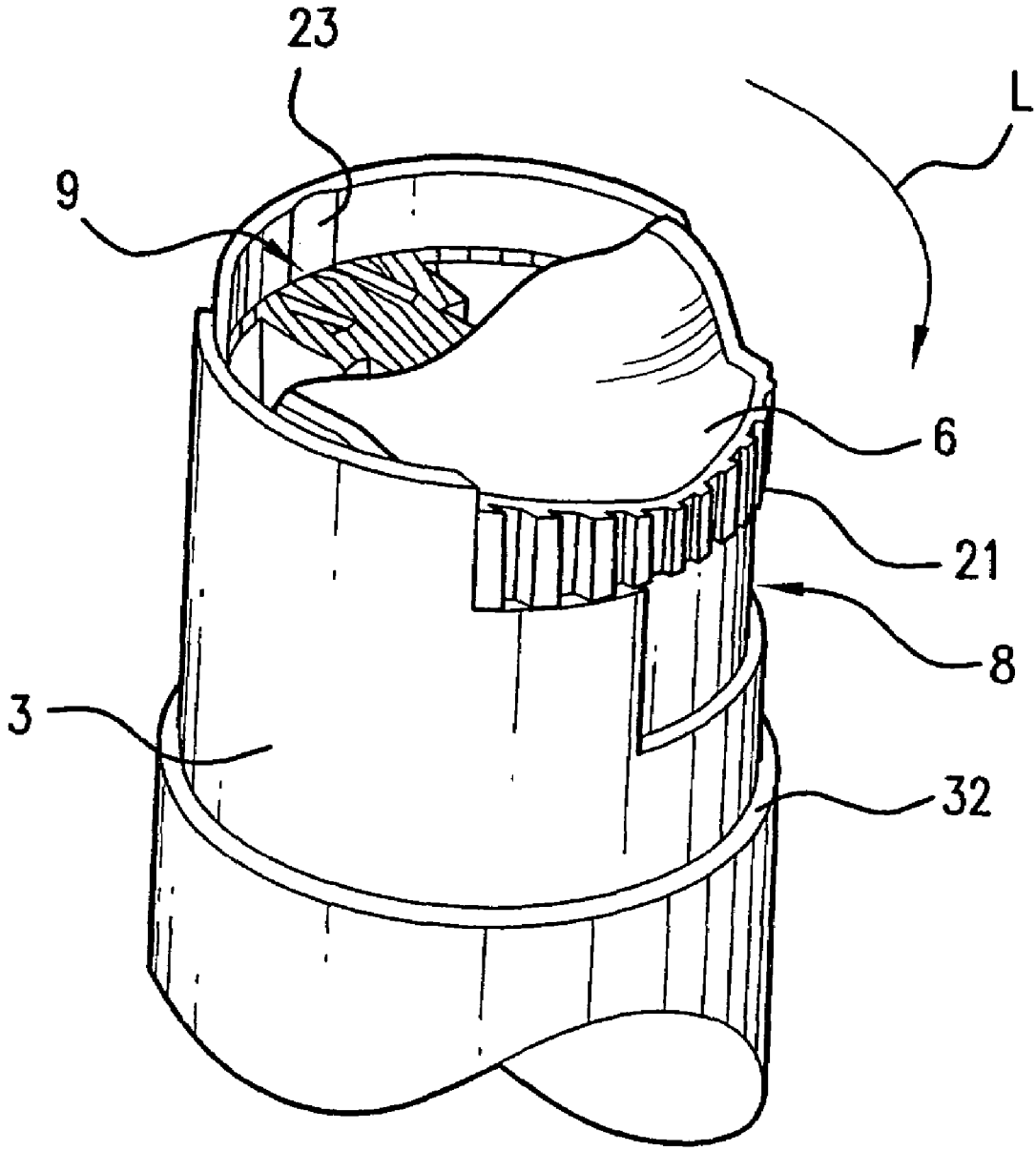
FIGS. 2-4 are perspective views of an actuator and locking mechanisms, wherein FIG. 4 includes a partial cross-sectional view.
Figure 4:
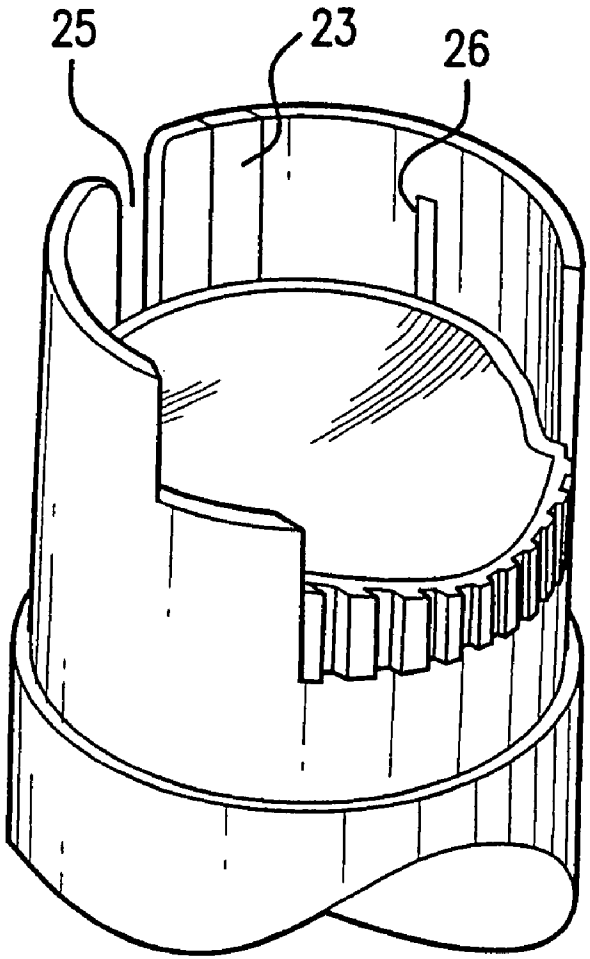
Figure 3:
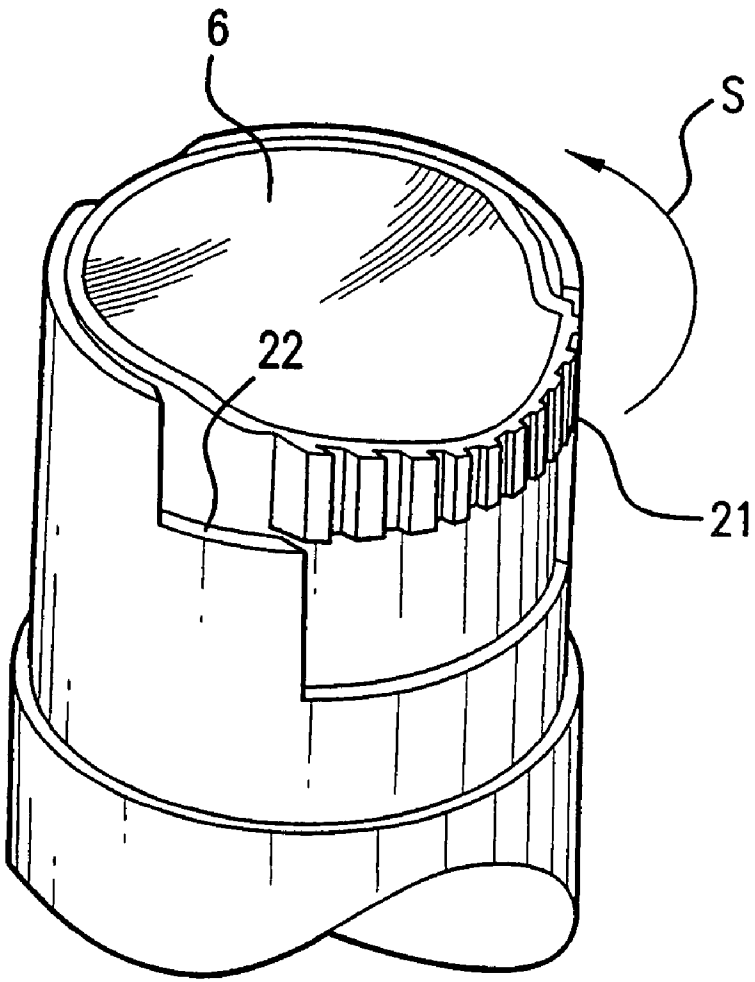

FIGS. 2-4 show the particular features of the actuator 6 of the dispenser, and the particular locking and retaining features of the upstanding wall 3. In FIG. 2, the forward portion of actuator 6 is shown in cross-sectional view, to show the manner in which the nozzle 9 is sealed in a non-dispensing position. Actuator 6 includes a projecting edge 21 which is used to rotate actuator 6 from a dispensing to a non-dispensing position, and which also acts to prevent downward movement of actuator 6 when actuator 6 is in a non-dispensing position. Upstanding wall 3 includes a limit stop 22 which prevents actuator 6 from moving downward and thus dispensing material from pump 12—via engagement with limit stop 22 (See FIG. 2). The position of the actuator 6 shown in FIG. 2 is the position in which the actuator 6 is kept before the tab 4 is removed from upstanding wall 3. In this position, nozzle 9, which includes a slightly projecting tip, is snapped into a vertical groove 23. Groove 23 acts to retain nozzle 9 and actuator 6 in a non-dispensing position, and also seals the nozzle 9 against the incursion of air into the nozzle 9 orifice.

Rotating actuator 6 in the direction indicated by arrow S places the actuator 6 and nozzle 9 into a spraying or dispensing position. In the actuator as disclosed in U.S. Pat. N0. 5,593,064, there was nothing to prevent this rotation. Thus, it could be done by a young child. In the dispensing position (shown in FIGS. 3 and 4) projecting edge 21 is in alignment with opening 8. In this position, nozzle 9 is aligned with opening 25 which is formed when tab 4 is removed. As seen by comparing FIGS. 3 and 4, projecting edge 21 travels within opening 8 upon downward actuation of actuator 6, allowing dispensing of material through nozzle 9 via pump 12. Rotating actuator 6 in the direction indicated by arrow L into a locking position, in which nozzle 9 is snapped into groove 23. Indication that nozzle 9 is properly in a non-dispensing position can be provided via a bead 26, which can contact a bead on the outer circumferential surface of actuator 6, thereby providing an audible "snapping" sound when the beads slide over one another.

Figure 5:
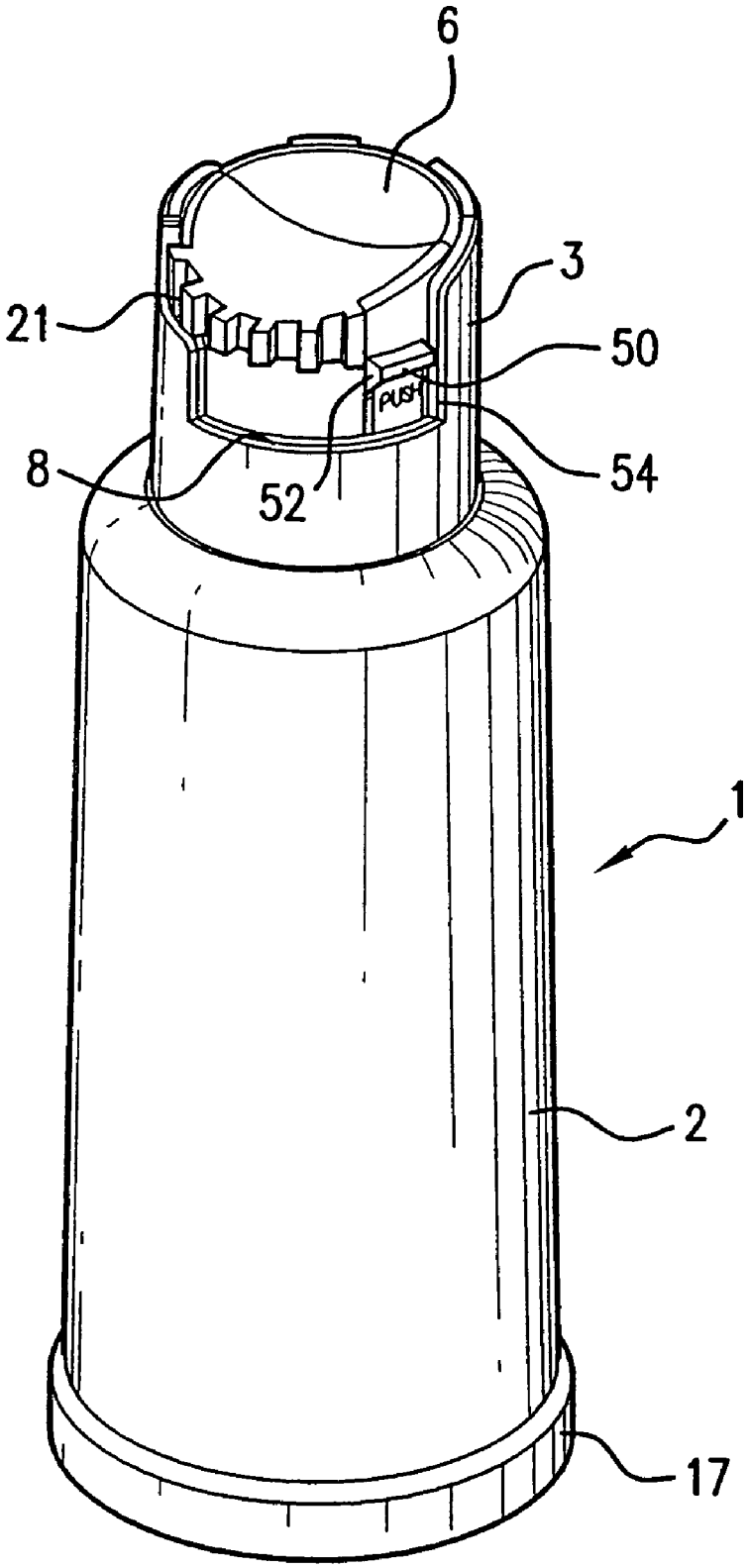
FIG. 5 is a rear perspective view of the dispenser with the safety tab of the present invention installed.

FIG. 5 is a rear perspective view of the package 1 of FIG. 1 in which the safety lock of the present invention is incorporated. Visible is the actuator 6 in sleeve 3. The sleeve 3 is a first part that is fixed. The actuator is a second part that is movable. i.e., rotatable. As noted above, the actuator must be rotated to align projecting edge 21 with opening 8. However, in accordance with the present invention, a safety tab 50 is formed in actuator 6 (the movable part) and has a projecting lip 52 which abuts a vertical wall 54 of opening 8 in the fixed part (sleeve 3) and prevents rotation. The tab 50 is hinged at its base and biased outwardly. To carry out rotation, one must push in on the tab 50 until the lip 52 clears the wall 54, while at the same time rotating the actuator 6. This is a two handed operation which is difficult for a small child to perform.

Figure 6:
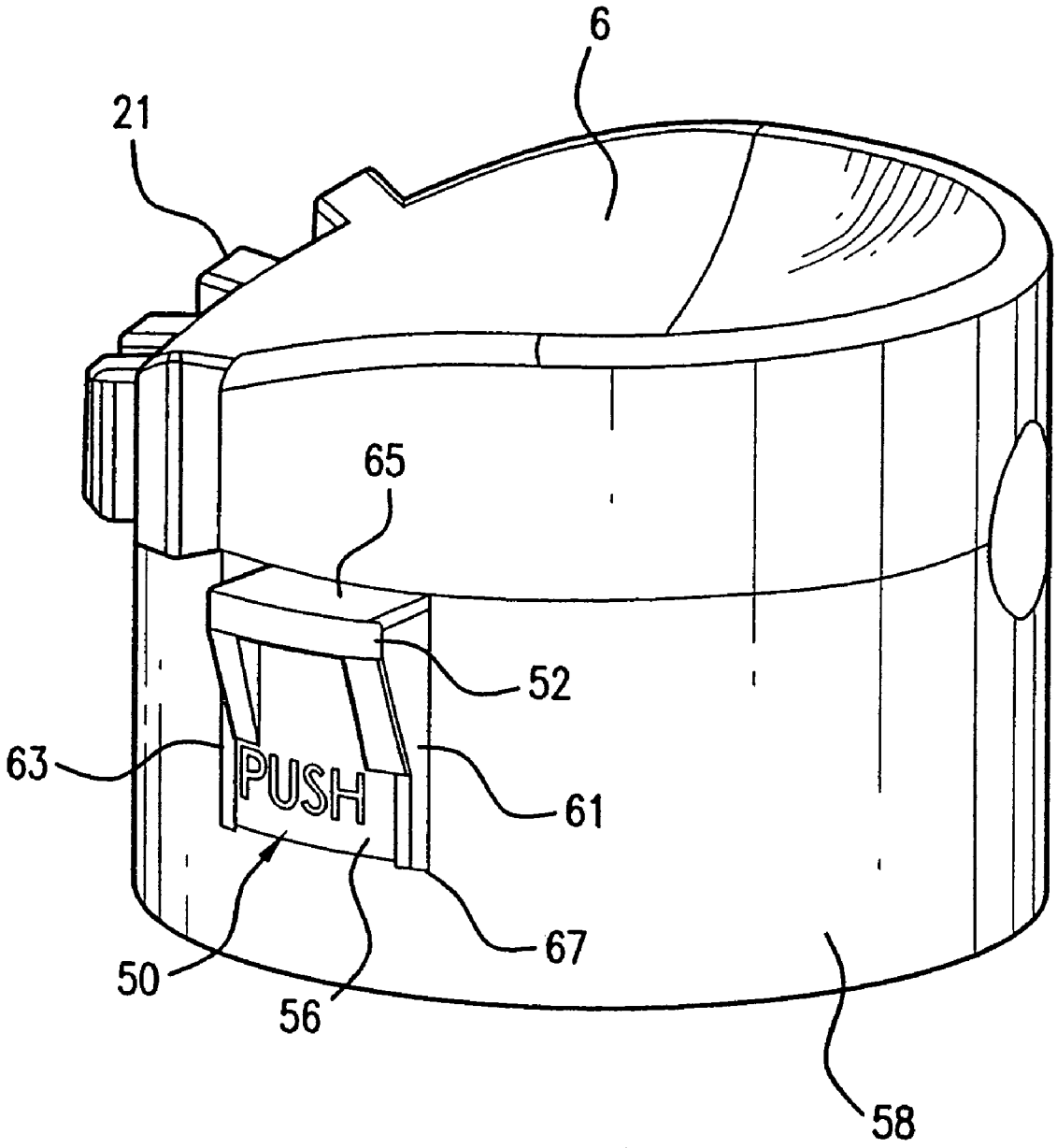
FIG. 6 is a perspective view of the actuator of the dispenser with the safety tab of the present invention.

FIG. 6 is a perspective view of actuator 6. In the illustrated embodiment, the tab 50 is molded in the wall 58 of the actuator 6. The base 56 of tab 50 is just a thinner section of wall 58. At the upper end of tab 50, the projecting lip 52 is formed. Vertical slits 61 and 63 and horizontal slit 65, extending through wall 58, separate tab 50 from the rest of the wall 58. Thus, by pushing in on the projecting lip 52, it can be forced to rotate about its base 56 which acts as a hinge. The fact that is an integral part of wall 58 insures that the projecting lip is biased outwardly. Although this is a simple way to form the biased hinged tab, other arrangement with different types of hinges and different forms of biasing may equally well be used.

The method of using the illustrated embodiment is as follows. The container 2 is molded as an integral unit with upstanding wall 3 and retaining wall 10. Container 2 is inverted, and may be inserted into a holding or restraining mechanism which interacts with shoulder 32 to restrain container 2 in an inverted position. Next, pump 12 is inserted into either the open end of lower end 16 or upper end including upstanding wall 3, so that the upper end of pump 12 fits through retaining opening 11 until flange 13 abuts retaining wall 10. Actuator 6, with tab 50 formed therein, can then be inserted onto the projecting stem 40 of pump 12.

The container 2 thus assembled is shipped together with bottom 17 (See, e.g., FIG. 1) in an unassembled condition to a filling and assembly location where it may be filled and labeled and shipped to an end user.

Upon receiving package 1, the customer breaks off tab 4, and then when dispensing is desired, rotates actuator 6 to the position shown in FIG. 5. To do this, as noted above, it is necessary to first press in on tab 50 until it clears wall 54 of opening 8, while at the same time carrying out a rotation. Downward actuation of actuator 6 dispenses liquid product from package 1, through nozzle 9. Upon completion of actuation, the actuator 6 is rotated back to the position shown in FIG. 5 and tab 50 snaps back in the position where the actuator can not be rotated without pushing it in again.

Figure 7:
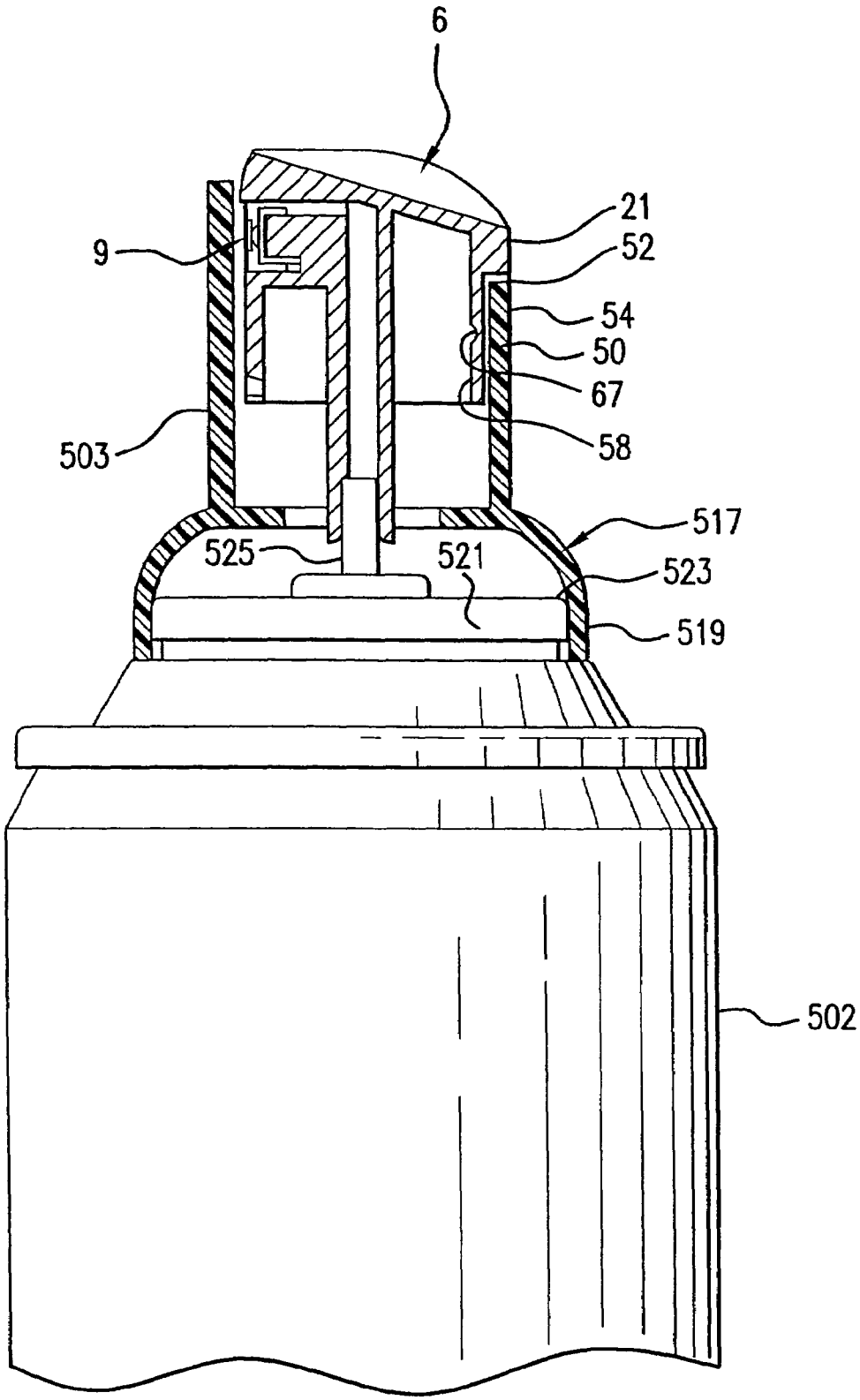
FIG. 7 is a cross-sectional view of an embodiment of the safety device of the present invention mounted on an aerosol dispenser.

The embodiment of FIG. 1 is directed to a pump. However, the actuators with spray nozzles described herein may also be used with aerosol valves. A specific example of an embodiment of the present invention used with an aerosol valve is shown in FIG. 7, which shows an aerosol container 502 with a mounting cap 517 which includes an embodiment of the nozzle closure of the present invention of the general nature shown in FIGS. 2-6. Container 502 may include, at its upper end, a mounting cup 521 having a beaded rim 523 extending around its entire circumference. The mounting cap 517 shown in FIG. 7 may include a cylindrical skirt 519 which engages beaded rim 523, with a press fit, attaching mounting cap 517 and its upstanding wall 503, to container 502. The mounting cap can also or alternatively be designed with a bead on its end, which will allow it to snap over the beaded rim 523. Wall 503 is constructed in a manner similar to wall or sleeve 3 of the previously explained embodiments. In conventional fashion, this is part of mounting cup 521. Mounting cup 521 contains an aerosol valve and has as its purpose mounting the aerosol valve to the top of container 502. A stem 525 for actuating the aerosol valve projects from the aerosol valve in conventional fashion. Downwardly extending projection of actuator 6 is pressed onto the projecting stem 525 to permit actuating the valve and dispensing material through nozzle 9.

The construction and operation of safety lock of the present invention is as explained above. The cross-sectional view of FIG. 7 shows tab 50 with projecting lip 52 abutting against wall 54. Base 67 of the tab 50 is a thinner section of the wall to act as a hinge. In the position shown, the dispensing outlet or nozzle 9 of the actuator 6 is behind wall 3 and dispensing is not possible. It is necessary to rotate actuator 6 to a position where nozzle 9 is aligned with an opening (not shown) such as the opening 25 of FIG. 4. In order to do this, the tab 50 must be pushed in, clear of the wall 54, and the actuator rotated at the same time, as described above, a difficult task for a small child.

In the embodiment of FIG. 1, the upstanding wall 3 is integral with the container. It will be recognized that just as the arrangement of the present invention can be added to a conventional aerosol dispenser, as illustrated in FIG. 7, it can also be added to an existing pump dispenser by providing a mounting cap which engages the body of the pump dispenser.

Furthermore, embodiments of the present invention have thus far been described in the context of liquid dispensing packages where material is dispensed under pressure from either a pump or an aerosol valve. However, it is equally applicable to other types of packages, where a safety feature is need. Examples, include medicine bottles, containers for household chemical etc. In an embodiment in which the hinged tab is on a rotatable part and the opening with a wall on the fixed part, all that is required is a sleeve attached to the container and within which a part (the actuator in the embodiments described above) is rotated to place the container in a position where dispensing can take place. In the illustrated embodiments the actuator is pressed to spray a material. If the container contained liquid or powder to be poured, the rotation would result in removal or partial removal of a cap. The sleeve has an opening with a wall against which an outwardly biased hinged tab on the first part abuts and prevents rotation, unless the tab is pushed in to clear the wall, while at the same time rotating the first part into an open or dispensing position.

Figure 8:
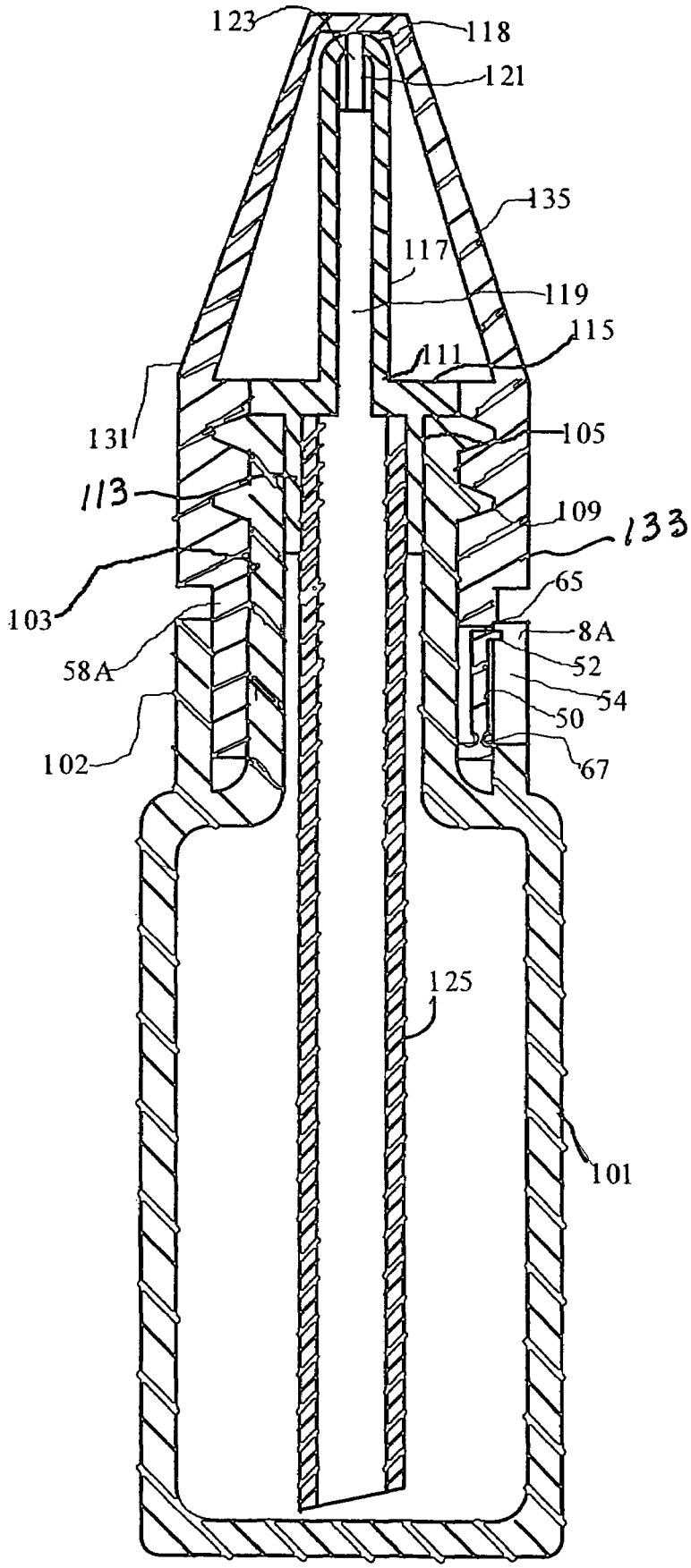
FIG. 8 is a cross-sectional view of a first embodiment of a squeeze bottle having the safety device of the present invention.

Another example of an embodiment of this nature is shown in FIG. 8, which is a cross-sectional view of a squeeze bottle dispenser having the safety lock of the present invention. The embodiment of FIG. 8 is useful, for example, for dispensing a material into the nasal passages. Similar arrangements are used for dispensing eye drops etc. It includes a bottle 101 made of a plastic material which is soft and can be deformed inwardly to carry out dispensing by squeezing the bottle. The top of the bottle 101, made of a harder plastic terminates in a threaded neck 103 with an opening 105.

Fixedly attached to the bottle 101, for example, press fit into opening 105, is a nozzle unit 111. It includes a lower cylindrical part 113, which is inserted into opening 105 on top of which is a flange 115 which abuts the top of neck 103 when the nozzle unit is forced into the opening 105. Extending outwardly from flange 115 is a hollow cylindrical nozzle 117, with a rounded end 118, forming a passage 119 for liquid to be dispensed from the squeeze bottle 101. An insert 121 with a narrow passage 123 acts to control and in some cases atomize the liquid dispensed. A dip tube 125 is inserted with a tight fit in the inside of lower cylindrical part 113.

The final part is a closure or cover 131. It includes a threaded base 133 which screws onto the neck 103 of bottle 101. A cylindrical wall 58A extends downwardly from the base 133. The bottle 101 is formed with an upwardly extending hollow cylindrical part 102 which functions as the aforementioned sleeve. When screwed on to the neck 103, cylindrical wall 58A is retained between cylindrical part 102 and neck 103. The cover has a conical upper part 135 that surrounds and protects the nozzle 117 from contamination when not in use. In order to use the dispenser, the cover 131 must be removed, to allow dispensing through the nozzle 117 upon squeezing of the bottle 101.

As in the safety latch shown in FIG. 7, a tab 50 is molded in the wall 58A of the closure 131. The base 67 of tab 50 is just a thinner section of wall 58A. At the upper end of tab 50, the projecting lip 52 is formed. Vertical slits (not visible in this view) and horizontal slit 65, extending through wall 58A, separate tab 50 from the rest of the wall 58A. Thus, by pushing in on the projecting lip 52, it can be forced to rotate about its base 67 which acts as a hinge. The fact that it is an integral part of wall 58A insures that the projecting lip is biased outwardly.

An opening 8A in cylindrical projection 102 has a vertical wall 54. The projection 52 abuts against this vertical wall. To unscrew the cover 131 from the bottle 101 requires pressing in on the tab 50 until the projection clears the vertical wall 54. This is a two-handed operation that is difficult for a child.

Figure 9:
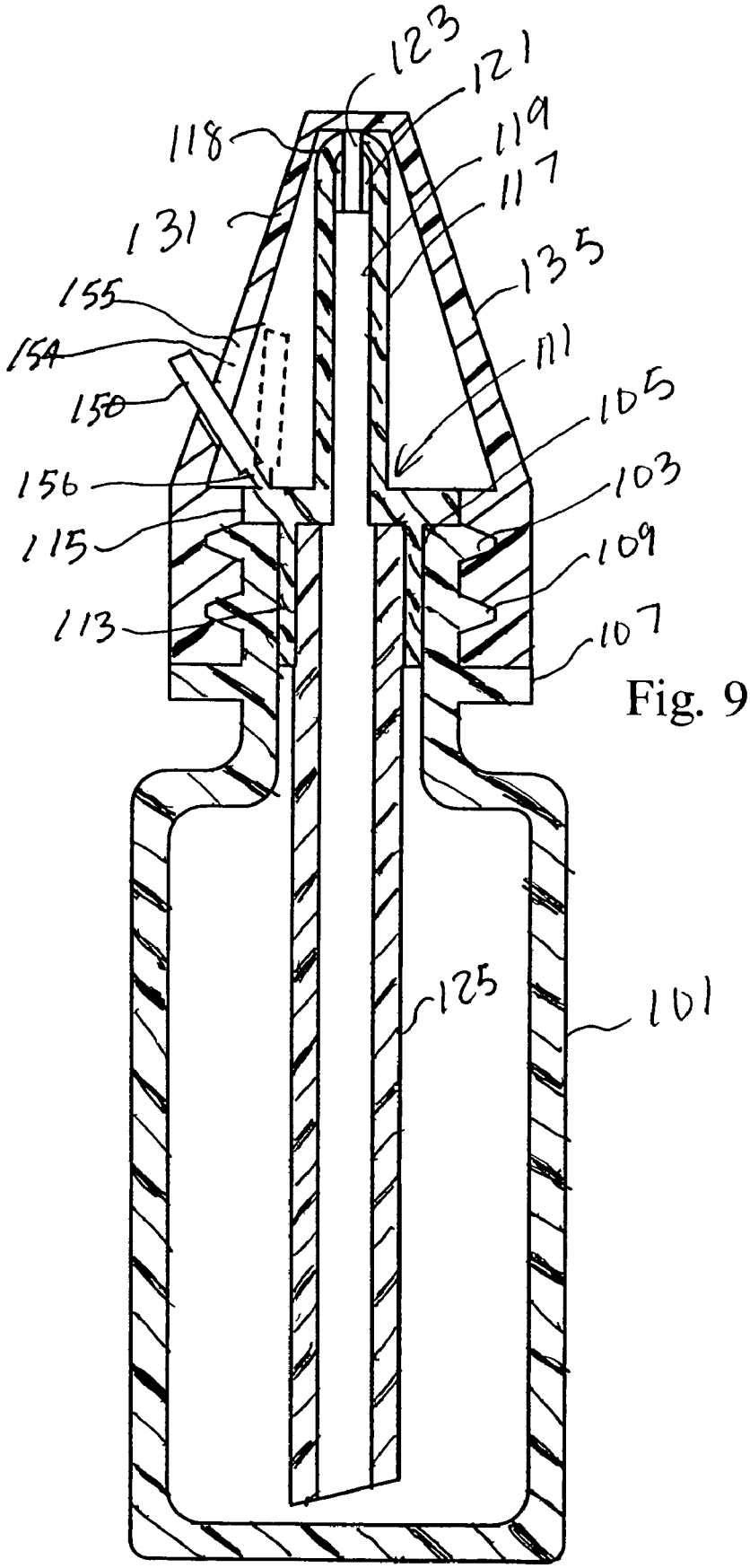
FIG. 9 is a cross-sectional view of a second embodiment of a squeeze bottle having the safety device of the present invention.

In the embodiments FIGS. 1-8, the hinge is on the movable part and the opening or recess is in the fixed part. An embodiment in which the hinged tab is on the fixed part and the opening on the movable part is shown in FIG. 9. The embodiment of FIG. 9 is a squeeze bottle dispenser generally the same as that of FIG. 8. Where parts are the same, the same reference numbers are used and those portions will not be again explained in detail. Only the differences will be described. In the embodiment of FIG. 9, the bottle 101 is slightly different in that a flange 107 is formed on neck 103 below threads 109.

The construction of nozzle unit 111 is generally as described above, as is the closure or cover 131, except that cover 131 does not include the cylindrical projection 102. Instead, when fully screwed in place, it abuts the flange 107.

The safety lock of the present invention is incorporated in this arrangement in the following manner. The nozzle unit 111, press fit into the bottle 101, is a first part that, along with bottle 101, is fixed. The cover 131 is a second part that is movable. i.e., rotatable. As noted above, the cover 131 must be removed in order to expose the nozzle. However, in accordance with the embodiment of FIG. 9, a safety tab 150 is formed extending from the flange 115 of the nozzle unit 111 (the fixed part) and abuts a vertical wall 154 of an opening 155 in the movable part (cover 131) and prevents rotation. The tab 150 is hinged via a thinner plastic section 156 at its base and biased outwardly. Tab 150 is integrally molded of plastic with the nozzle unit 111 and thus properly biased. To carry out rotation, one must push in on the tab 150 until it clears the wall 154, while at the same time rotating cover 131. This is a two handed operation which is difficult for a small child to perform.

The above-described embodiment of FIG. 9 provides a simple three piece arrangement that can be placed on a squeeze bottle at the time of filling, which arrangement provides a childproof safety lock. The three parts are a nozzle unit, a dip tube, and a cover. The nozzle unit includes a hinged tab and the cover includes a matching opening with a wall against which the tab will abut when the parts are assembled to a squeeze bottle.

Figure 10:
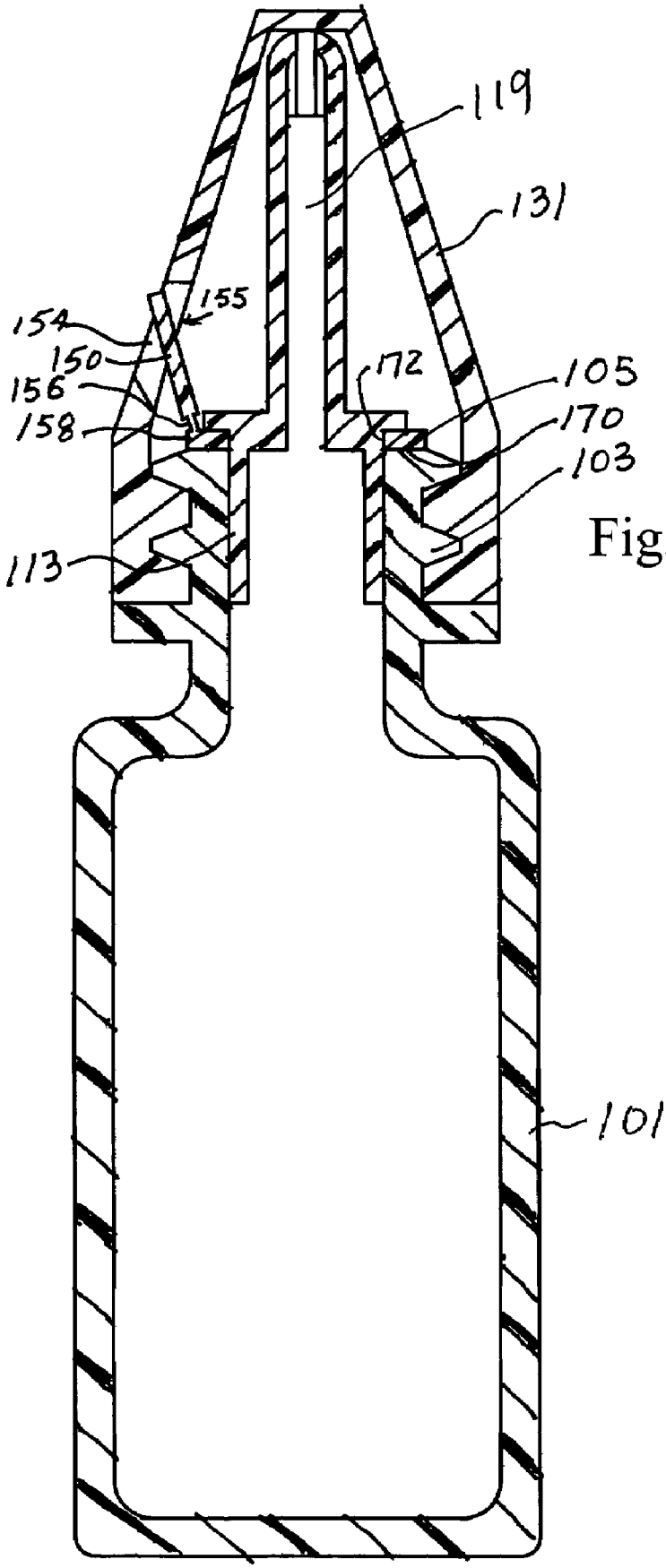
FIG. 10 is a cross-sectional view of a second embodiment of a squeeze bottle having the safety device of the present invention.

FIG. 10 shows a further embodiment of a squeeze bottle, illustrating possible modifications to the embodiments of FIGS. 8 and 9. First, the embodiment is shown without a dip tube. This embodiment and the embodiments of FIGS. 8 and 9 can be constructed without dip tubes when used for dispensing drops or the like, such as eye drops. In that case the bottle 101 will be inverted during dispensing so that the liquid being dispensed will reach passage 119 directly. Of course, if the embodiment of FIG. 10 is to be used for dispensing a nasal spray, for example, it will be provided with a dip tube as shown in FIGS. 8 and 9.

A second difference in the embodiment of FIG. 10 relates to the hinged tab 150. In this embodiment the thinner section 156 at its base extends from and is part of a washer 158. The tab 150 including base 156 is integrally molded of plastic with the washer 158. The washer 158 rests on the top 170 of the bottle neck 103. Nozzle unit 111 has its lower cylindrical part 113 extending through the central opening 172 in the washer 158 and then into the opening 105 of the neck with a press fit. This holds the washer fixed in place. Operation is as described above. The tab 150 abuts a vertical wall 154 of an opening 155 in the cover 131 to prevent rotation. To carry out rotation, one must push in on the tab 150 until it clears the wall 154, while at the same time rotating cover 131, a two handed operation which is difficult for a small child to perform.

This embodiment employing a washer 158 which includes the tab 150 has a number of advantages. It is easier to mold the tab as part of the washer than part of the nozzle unit. In addition, the plastic material for the washer and tab can be different from that of the nozzle unit. It can be selected to give a good hinge action, and good biasing into the lock position. In addition the tab can be made of a different color to make it easily identifiable. Furthermore, making this a separate part gives more ability to select plastics for the nozzle, and the other parts, that are most compatible with the material being dispensed, without the need to take into account the hinge action and biasing of the tab.

In addition, this embodiment lends itself to be an easy addition to a conventional construction at the time of filling and assembly. The embodiment of FIG. 10 can provide a kit to provide child proofing of a bottle and its nozzle unit, with or without a dip tube attached. The kit includes only the washer 158 with attached tab 150 and the cover 131 with its matching opening or recess 155.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. A safety latch for a dispensing package having a first fixed part and a second movable part that is movable from a first position where dispensing is prevented to a second position where dispensing is possible, comprising:

a. a recess having a wall extending in a direction approximately perpendicular to a direction of movement of said second movable part to the second position, said recess being in the second movable part; and b. a hinged tab on the first fixed part, said tab biased to have a portion abutting said wall and preventing movement, unless the tab is pushed in so that the portion clears the wall, while at the same time moving the second movable part to the second position; and said first fixed part comprises:

a squeeze bottle having a threaded neck with an opening at its end; and a dispensing nozzle unit fixedly inserted into said opening; and said second movable part comprises:

a cover for said nozzle unit having internal threads to screw onto said neck, said cover having said recess formed therein;

wherein said nozzle unit is attached to the opening in the neck of said bottle and further includes a washer, fixedly mounted in the vicinity of said opening and wherein said hinged tab is part of and extends from said washer.

2. The safety latch of claim 1 and further including a dip tube extending from said dispensing nozzle unit into said squeeze bottle.

3. The safety latch of claim 1 wherein said hinged tab is part of and extends from a top of said nozzle unit.

4. The safety latch of claim 3 wherein said nozzle unit includes a lower cylindrical part terminating in a flange, said lower cylindrical part inserted in said opening in the neck of said bottle and wherein said hinged tab is part of and extends from said flange.

5. An attachment for a dispensing container including a bottle with a threaded neck with an opening at its end comprising:

a. a first fixed part that is adapted to be disposed at the end of said neck;

b. a second movable part having internal threads to screw onto said neck, unscrewing resulting in movement of said second movable part from a first position where dispensing is prevented to a second position where dispensing is possible;

c. a recess having a wall extending in a direction essentially perpendicular to a direction of movement of said second movable part to the second position, said recess being in the second movable part; and d. a hinged tab on the first fixed part, said tab having a portion abutting said wall and preventing movement, unless the tab is pushed in so that the portion clears the wall, while at the same time moving the second movable part to the second position:

wherein said bottle comprises a squeeze bottle, said first fixed part comprises:

a dispensing nozzle unit fixedly inserted into said opening, and said second movable part comprises:

a cover for said nozzle having internal threads to screw onto said neck, said cover having said recess formed therein;

wherein said nozzle unit is attached to the opening in the neck of said bottle and further including a washer, fixedly mounted in the vicinity of said opening and wherein said hinged tab is part of and extends from said washer.

6. The attachment of claim 5 and further including a dip tube extending from said dispensing nozzle unit into said squeeze bottle.

7. The attachment of claim 5 wherein said hinged tab is part of and extends from a top of said nozzle unit.

8. The attachment of claim 7 wherein said nozzle unit includes a lower cylindrical part terminating in a flange at its upper end, said lower cylindrical part inserted in said opening in the neck of said bottle and wherein said hinged tab is part of and extends from said flange.

9. A childproof dispensing bottle comprising:

a bottle having a longitudinal axis comprising:

a lower portion, a neck portion, the neck portion extending upwardly from the lower portion, a central portion, the central portion having an upstanding wall extending upwardly from the lower portion, the upstanding wall extending substantially around the neck portion thereby defining an annular space between the central portion and the neck portion, the upstanding wall having an opening adapted to receive a tab extending from a cap; and a cap comprising:

a top portion enclosing a top of the neck portion, and a bottom portion that is received in the annular space between the central portion and the neck portion, the bottom portion comprising a tab, the tab biased to project into the opening in the upstanding wall of the central portion, and the tab being capable of being pushed inwardly to clear the upstanding wall;

wherein when the cap is in a locked position, the tab projects into the opening in the upstanding wall and in order to move the cap to an unlocked position, the tab is pressed inwardly while the cap is simultaneously rotated around the longitudinal axis.

10. The container of claim 9, wherein the tab further comprises a projecting lip.

11. The container of claim 9, wherein the tab comprises a base that is thinner than the remainder of the tab to create a hinge.

12. The container of claim 9, further comprising a nozzle connected to the top of the neck portion.

13. The container of claim 12, wherein the nozzle is press fit into a lumen of the neck portion.

14. The container of claim 12, wherein the nozzle further includes an atomizing insert.

* * * * *